US010471763B2

(12) United States Patent
Ghodsian

(10) Patent No.: US 10,471,763 B2
(45) **Date of Patent: *Nov. 12, 2019**

(54) CORNER PAPERCLIP

(71) Applicant: Shahrouz Ghodsian, Los Angeles, CA (US)

(72) Inventor: Shahrouz Ghodsian, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/384,005

(22) Filed: Dec. 19, 2016

(65) Prior Publication Data

US 2017/0165998 A1 Jun. 15, 2017

Related U.S. Application Data

(63) Continuation of application No. 14/348,524, filed as application No. PCT/US2012/058053 on Sep. 28, 2012, now Pat. No. 9,522,559.

(60) Provisional application No. 61/598,737, filed on Feb. 14, 2012, provisional application No. 61/541,179, filed on Sep. 30, 2011.

(51) Int. Cl.

| | |
|---|---|
| ***B42F 1/12*** | (2006.01) |
| ***B42F 1/04*** | (2006.01) |
| ***B42F 1/02*** | (2006.01) |
| ***B42F 1/08*** | (2006.01) |
| ***B42F 1/10*** | (2006.01) |
| ***B42F 1/06*** | (2006.01) |

(52) U.S. Cl.

CPC ..... *B42F 1/12* (2013.01); *B42F 1/02* (2013.01); *B42F 1/04* (2013.01); *B42F 1/06* (2013.01); *B42F 1/08* (2013.01); *B42F 1/10* (2013.01); *Y10T 24/202* (2015.01)

(58) Field of Classification Search

CPC ..... B42F 1/12; B42F 1/04; B42F 1/06; B42F 1/02; B42F 1/08; B42F 1/10; Y10T 24/202

See application file for complete search history.

(56) References Cited

U.S. PATENT DOCUMENTS

| | | | | |
|---|---|---|---|---|
| 586,003 A * | 7/1897 | Bennett | ..... | B42F 1/12 24/67 CF |
| 714,388 A * | 11/1902 | Mussinan | ..... | B42F 1/08 24/552 |
| 751,531 A * | 2/1904 | Mayers | ..... | B42F 1/08 24/547 |

(Continued)

*Primary Examiner* — Robert Sandy
*Assistant Examiner* — Louis A Mercado
(74) *Attorney, Agent, or Firm* — Shahrouz Ghodsian

(57) ABSTRACT

A reusable paperclip can accommodate a large range of paper stack sizes. It is configured to bind a stack from one corner without becoming distorted in shape when used on a large stack. The clip has vertical members to prevent horizontal and vertical movement of the stacked papers and connected horizontal members to apply pressure to the surfaces of the stack to frictionally bind the stacked papers. The clip is easily placed and removed by the user, and allows a person to view all information on a standard formatted page with little to no obstruction of the printed information. The clip also allows a user to flip though a stack of papers and easily remove individual papers from the stack or insert additional pages without disturbing the sheets and without the need to remove or adjust the position of the clip.

8 Claims, 11 Drawing Sheets

(56) References Cited

U.S. PATENT DOCUMENTS 764,719 A * 7/1904 Gorton ..... B42F 1/08 24/547
767,512 A * 8/1904 Bronson et al. ..... B42F 1/02 24/67 R
1,456,551 A * 5/1923 Harvey ..... B42F 1/08 24/546
1,753,094 A * 4/1930 Sacerdote ..... B42F 1/08 24/552
1,914,671 A * 6/1933 O'Neil ..... G09F 3/16 24/547
1,989,953 A * 2/1935 Tibbals ..... B42F 1/08 24/552
2,052,887 A * 9/1936 Lewis ..... B42F 1/08 24/547
2,074,613 A * 3/1937 Laursen ..... B42F 1/08 24/552
2,843,900 A * 7/1958 Nye ..... B42F 1/08 24/67.9
2,908,954 A * 10/1959 Chaun ..... B42F 1/08 24/67.9
3,564,674 A * 2/1971 Chaplin ..... B42F 1/08 24/545
4,170,052 A * 10/1979 Okerblom ..... B42F 1/08 24/552
4,237,587 A * 12/1980 Hsiao ..... B42F 1/08 24/555
5,010,629 A * 4/1991 Hirzel ..... B42F 1/02 24/547
5,022,124 A * 6/1991 Yiin ..... B42F 1/08 24/546
5,214,825 A * 6/1993 Hirzel ..... B42F 1/02 24/547
5,655,266 A * 8/1997 Gish ..... B42F 1/08 24/67.3
2002/0166213 A1* 11/2002 Mattesky ..... A47F 5/0869 24/17 R
2009/0151129 A1* 6/2009 Crosson ..... B42F 1/08 24/67.9

* cited by examiner

CORNER PAPERCLIP

CROSS-REFERENCE TO PRIOR APPLICATIONS

The present application claims benefit and priority from U.S. Provisional Patent Application 61/541,179, filed 30 Sep. 2011, and 61/598,737, filed 14 Feb. 2012 which applications are incorporated herein by reference to the extent permitted by governing law and regulation; the present application is a continuation of application Ser. No. 14/348,524, now U.S. Pat. No. 9,522,559, filed on 28 Mar. 2014 which was the U.S. National Phase of PCT/US2012/058053, filed on 28 Sep. 2012.

U.S. GOVERNMENT SUPPORT

Not Applicable

BACKGROUND OF THE INVENTION

Area of the Art

DESCRIPTION OF THE BACKGROUND

Currently there is no removable, adjustable and expandable clip that binds a stack of papers together at their corners. There is no clip device that has the utility of a paper staple but the non-damaging characteristics, adjustability and disposability of a paper clip. Currently available paper clips also have the problem of allowing for vertical and horizontal movement of the papers held together.

Presently available devices that hold together a stack of papers are staples, paper clips or binder clips. However, all of these devices suffer from inherent design flaws that reduce their usefulness. Current paper clips are not designed to hold a stack of papers together by its corner edges. Such clips are also not designed to expand to accommodate a variable size stack of papers. When a person wants to flip through a stack of papers bound by a paper clip it is difficult and often results in the paper clip slipping and becoming unfastened from its original position. When a large stack of paper requires binding, a traditional paper clip will become distorted in shape due to the small number of sheets it can hold together. An ordinary paper clip also cannot limit the lateral and horizontal movement of the papers it holds together so that the bound sheets are liable to slippage in a direction parallel to the plane of the sheets.

These problems are only partially addressed by metal binder clips. The problem with metal binder clips is that they are not disposable; they are relatively expensive and based on the number of paper sheets that need to be held together, many different sizes of metal binder clips must be bought. Binder clips can also cause creasing of the bound sheets and can obstruct the view of the reader due to their significant size. Also, the binder clips are sufficiently large to impede stacking multiple bound documents. While binder clips can be placed at the corner edge of a paper stack, they are not designed for such placement and often slip off when so placed. While staple readily fasten paper stacks by their corners, staples are not easily removable and must be used in conjunction with a cumbersome stapling device. If a person would like to remove a paper from a stapled stack, then the staple must first be removed leaving marks and holes in the paper—not to mention in the user's finger from trying to remove the staple. Additionally, staples often cause ripping of the fastened papers.

SUMMARY OF THE INVENTION

The claimed invention differs significantly from currently available clips. Current art paper clips have the problem of permitting vertical and horizontal movement of the clipped papers. They are also limited to clipping only a small range of paper stack thicknesses before the structure of the clip becomes deformed and is rendered non-functional. Although binder clips provide the ability to clip stacks with a greater range of thicknesses, binder clips are generally expensive, obtrusive and not meant to be disposable.

By utilizing the claimed invention, a variable number of papers are bound together at their corner edge in a manner that allows removal and addition of individual papers without the need to remove the clip. The device contacts the stack at two separate points to apply holding pressure, thereby achieving a more stable and firm means for holding papers. The device also limits lateral and vertical movement of the aggregated papers to stabilize the paper stack. The device is unobtrusive, economical, reusable, easily placed and removed from paper and yet small enough and simple enough to be disposable. The corner of the paper stack is bound in such a way as to facilitate reading each sheet with minimal visual obstruction while permitting the user to flip through the stack and remove sheets from the stack without disturbing the position of the other sheets in the stack or moving the device itself.

Unlike current paper clips, the device according to this invention holds papers together in place at the corner and allows removal and addition of papers without removing the device.

The device also is flexible to hold different numbers of paper sheets while still providing a strong grip. The device also prevents lateral and vertical movement of the papers it holds together.

DETAILED DESCRIPTION OF THE INVENTION

Figure 1:
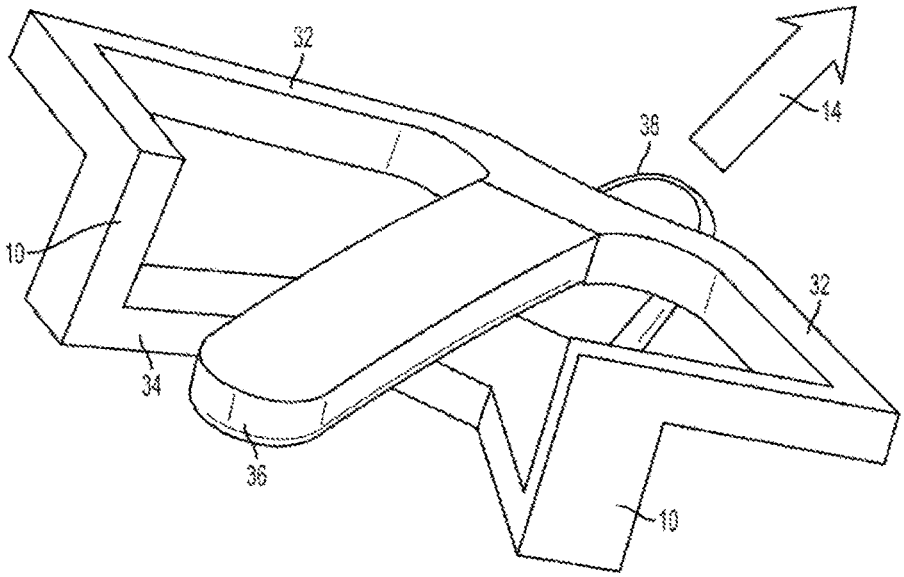
FIG. 1 shows a perspective view of a molded embodiment of the device.
Figure 2:
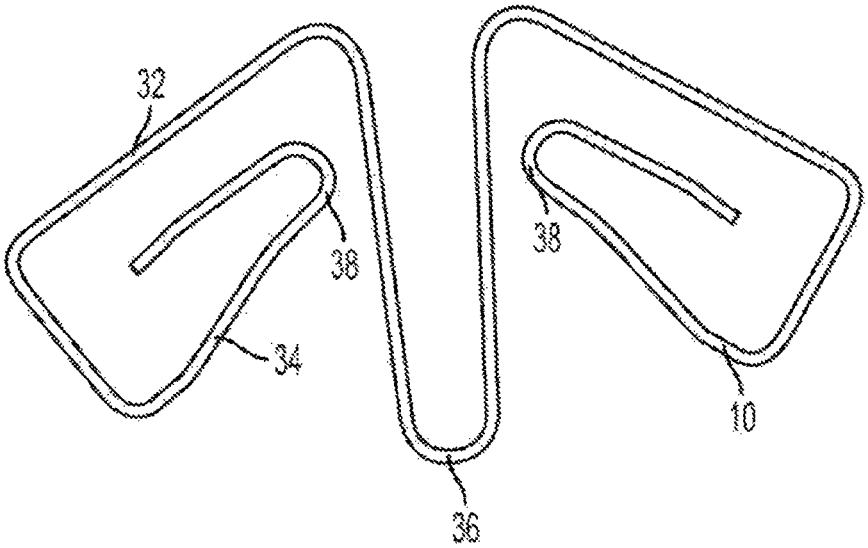
FIG. 2 shows a view of an embodiment of the device formed from bent wire.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a readily removable corner clip for a stack of papers.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a readily removable corner clip for a stack of papers.

Current devices used to hold together a stack of papers include staples, paper clips and binder clips. However, all of these devices suffer from inherent design flaws that reduce their usefulness. Ordinary paper clips are not able to hold paper stacks together at their corner edges in a manner that prevents papers from slipping out of the stack. They are also not designed to expand to accommodate a variable size stack of papers. When a person wants to flip through a stack of papers bound by a paper clip, it is difficult and often results in the paper clip slipping and becoming unfastened from its original position. When a large stack of paper requires binding, a traditional paper clip will become distorted in shape due to the small number of papers it can hold together and the narrow range of motion it has to accommodate large paper stacks. A paper clip also cannot limit the lateral movement of the papers it holds together. The problem with metal binder clips is that they are not disposable; they are relatively expensive and based on the number of papers that need to be held together, many different sizes of metal binder clips are needed. Binder clips can also cause creasing of the papers they hold and can obstruct the view of the reader. Staples are not easily removable and must be used in conjunction with a cumbersome stapling device. If a person would like to remove a paper from a stack bound together by a staple, the staple must first be removed leaving marks and holes in the paper. Additionally, staples can cause ripping of paper.

My new device addresses the deficiencies of existing paper stack binding devices. It is reusable and yet inexpensive enough to be disposable; it can accommodate a large range of paper stack sizes, is flexible and expandable in its holding capacity and will not become distorted in shape when used on a large stack of paper. This clip invention is easily placed and removed by the user, and allows a person to view all information on a standard formatted page with little to no obstruction of the information printed on the paper because the clip covers only the corner of the stacked papers. This clip also allows a user to flip though a stack of papers and easily remove individual papers from the stack or insert additional pages without disturbing the other papers and without the need to remove or adjust the position of the clip. This type of clip does not result in creasing or tearing of the papers it holds together. This clip also prevents horizontal and vertical movement of the stacked papers.

Although primarily directed to stacks of paper, the inventive design lends itself to any application that requires multiple flat sheets to be held bound together in stacks. Larger and stronger versions of this device can be used to hold heavy flat surface objects such as sheets of cardboard, metal or plywood. This design can be used in lifting and transporting by temporarily fastening hooks to the corners of stacks. The design of this device may also be used as a bookmarker and place holder. This design could even be used to secure loose items to one's clothing. When combined with a wall mount or magnet, this design can also be used to hold papers and other materials securely to a surface (e.g. a refrigerator door).

The clip of the present invention can either be formed by bending resilient wire (e.g. spring wire) like a traditional metal paper clip or molded in one piece from a resilient plastic polymeric material or a resilient metal alloy. The device might also have a composite structure where one material provides resiliency or "springiness" to certain regions of the device and another material is used to form the rigid parts of the device. Both the wire embodiment and the polymeric embodiment share the same basic structural features, but the various embodiments necessarily have differences occasioned by the characteristics of the material and manufacturing methods. Rather than attempting to provide a detailed structural description without background, the device will be broken down into a number of structural-functional domains which will allow ready understanding of the device.

FIG. 1 represents an idealized version of the device. This version is quite similar to the embodiments molded from polymers and the like. Embodiments formed from bent wire necessarily have a somewhat different appearance albeit with the same functional domains. FIG. 1 is a perspective view from above. A stack of papers can be bound by sliding the clip onto the stack in the direction indicated by the arrow 14. That is, if a corner of the stack is placed over arrow 14 and the clip is moved in the direction indicated by the arrow—from the lower left towards the upper right—the clip will move over the stack corner until the framing segments 10 run into the sides of the stacked sheets.

Stack Frame.

Figure 3:
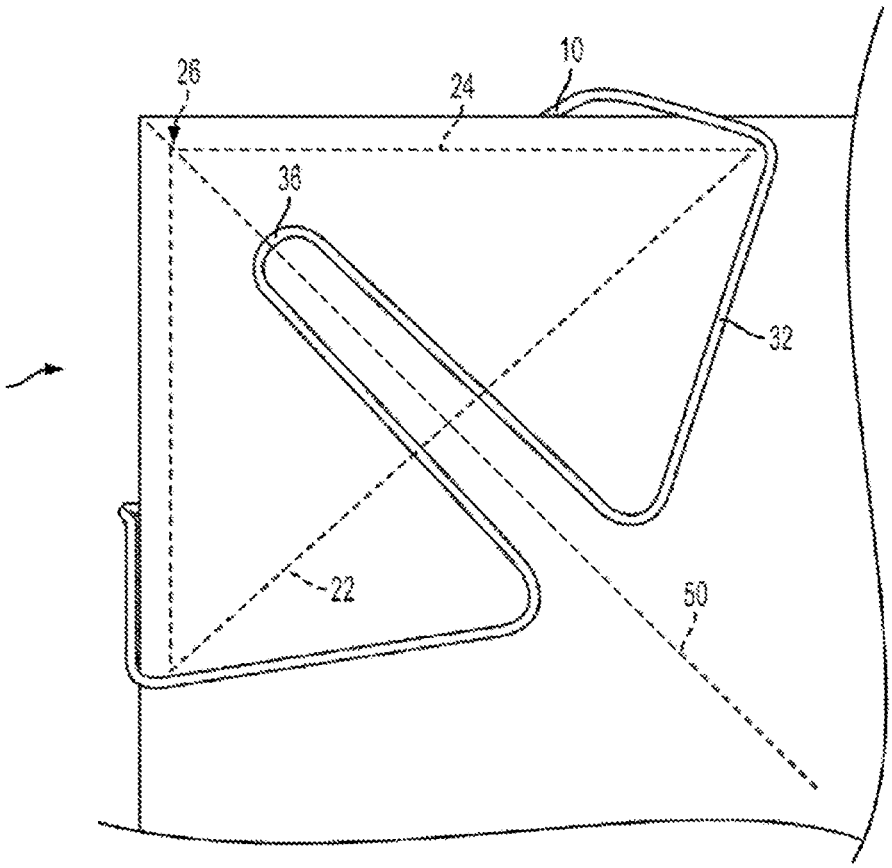
FIG. 3 shows the embodiment of FIG. 2 binding a stack of paper.

When a stack of papers is bound by sliding the clip over one of the corners or the stack, stack alignment is maintained by a "stack frame." The stack frame is formed by two framing segments 10 that are oriented approximately at right angles to the surface of the sheet (that is, parallel to the height of the stack), and the other parts of the clip that hold the framing segments at a fixed distance apart. When the clip is slid onto the corner of a stack (sliding from the corner towards the center of the sheet) the framing segments act as "stops" by intersecting the side edges of the stack. This prevents sliding the clip farther towards the center of the stack. More importantly, the framing segments act as guides to stabilize the clipped sheets against horizontal and vertical motion. The corner of a paper stack with the clip in place can be visualized as a right triangle 20 (see FIG. 3) where the hypotenuse (dotted line 22) represents a line running between the framing segments 10 and the legs (dotted lines 24) of the triangle represent lines from the triangle's apex 26 (adjacent the stack corner 12) to each of the framing segments 10. Although the clip can be made so that the framing members 10 are disposed so as to not form an isosceles right triangle, the more the configuration diverges from an isosceles right triangle, the more asymmetric the clip placement becomes with a concomitant loss of stack stability and ease of sheet flipping.

In a preferred embodiment the axis of each framing segment is approximately at right angles to the height of the clipped paper stack. The framing segments 10 form the side boundaries to the stack frame and are connected at either end to portions of the clip that control the upper and lower surfaces of the stack. FIG. 1. shows a perspective view from "above" of an idealized partial clip showing the stack frame. Of course, the clip can be inserted in either orientation on a stack so the terms "above" and "below" are relative. Because the clip is designed to contain a stack varying from a single sheet to a stack having a thickness equal to the length of the vertical framing segments 10, the portions forming either the upper and/or lower surfaces of the device are resiliently biased towards each other so as to grip a single sheet of paper or to elastically deform so as to accommodate an entire stack of sheets. In a polymeric version of device resiliency is a property of the polymer. The approximately right angle junctions between the framing segments 10 and the other portions of the device can be converted into sweeping radius bends to enhance the resiliency. Although the framing segment 10 is described as being at right angles to the stack height, it can also be configured to make other angles with the height. However, the right angle configuration results in a compact clip that can accommodate a large stack.

Pressure Members.

It will be understood that any paper clip operates by applying pressure to the surface of the paper or papers clipped together. The pressure causes friction between the sheets and the clip, and between adjacent sheets to immobilize the entire arrangement. A classic paper clip presents two overlapped wire ellipses. When inserted on to a paper almost the entire length of the ellipses apply pressure to the paper. With a binder clip the straight jaws of the clip apply the pressure. In both these cases it is primarily the applied pressure which immobilizes the bound sheets. With the inventive device the framing segments 10 limit the edges of the stack and keep the stacked sheets straight and limit movement of the papers without actually supplying immobilizing pressure. Instead, the upper surface segments 32 and the lower surface segments 34 of the clip provide contact regions—upper and lower pressure members 36, 38, respectively—to press the lower and upper sheets of the stack towards one another to hold the sheets in place frictionally. The resilient nature of the material used to construct the clip (e.g. springy wire) provides the force as the inserted sheets move the pressure members apart. Because the features explained above can be realized with a number of different materials and fabrication methods, a variety of embodiments exist.

One can attain an appreciation for the geometry of the device by describing it in relation to a clipped stack of papers. Extensions of surface segments 36, 38, on each surface of the stack, intersect the framing segments 10 approximately at right angles (thus, they are approximately parallel to the surface of the paper). The surface segments extend away from the edge contacted by the associated framing segment and extend towards the opposite edge of the sheet. In one embodiment of the device the segments from the two framing segments would intersect the diagonal line 50 at approximately right angles (if extended) (see FIG. 3) to define the corner of an imaginary square. From the intersection, a first pressure member 36 extends towards the paper corner. In the case of a clip bent from resilient spring wire (as in FIG. 3), the first surface (upper) pressure point 36 can be formed as a "U" shaped tongue of wire continuous with the wire that forms the framing and surface segments. When the clip is molded from resilient polymer, the first surface pressure member is advantageously a flattened member with a rounded tip (as in FIG. 1). The first surface pressure member is resiliently biased, or angled or curved downwards towards the bottom of the stack to contact and apply pressure to the sheet at a point in proximity to the clipped corner of the clipped sheets. The pressure member may apply pressure to a discrete point (limited point of contact with the stack surface) of the pressure member may apply pressure along a considerable length. Other embodiments may have a plurality of first surface pressure members.

Figure 4:
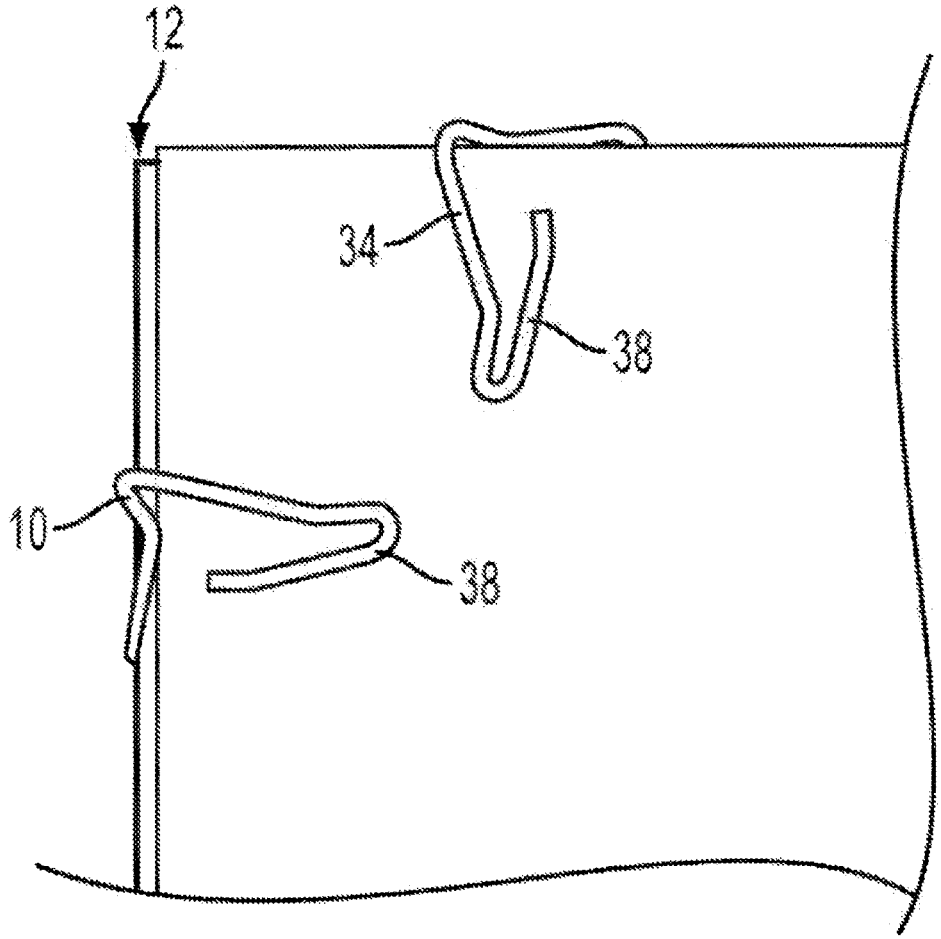
FIG. 4 shows the device of FIG. 3 viewed from the other surface of the stack.
Figure 5:
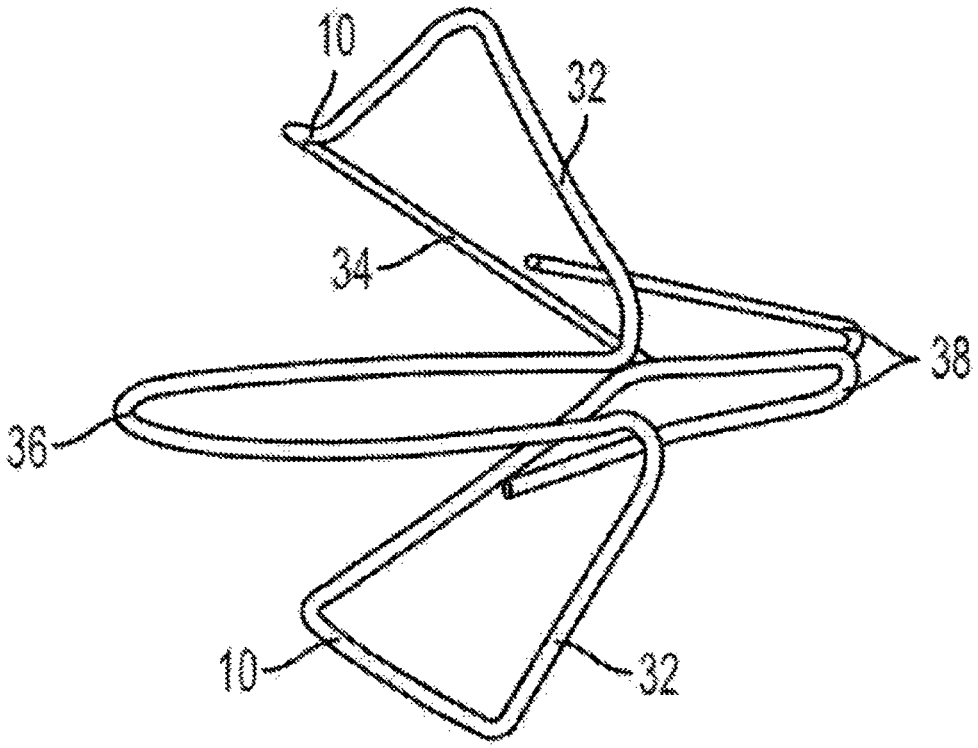
FIG. 5 shows a second bent wire embodiment.
Figure 6:
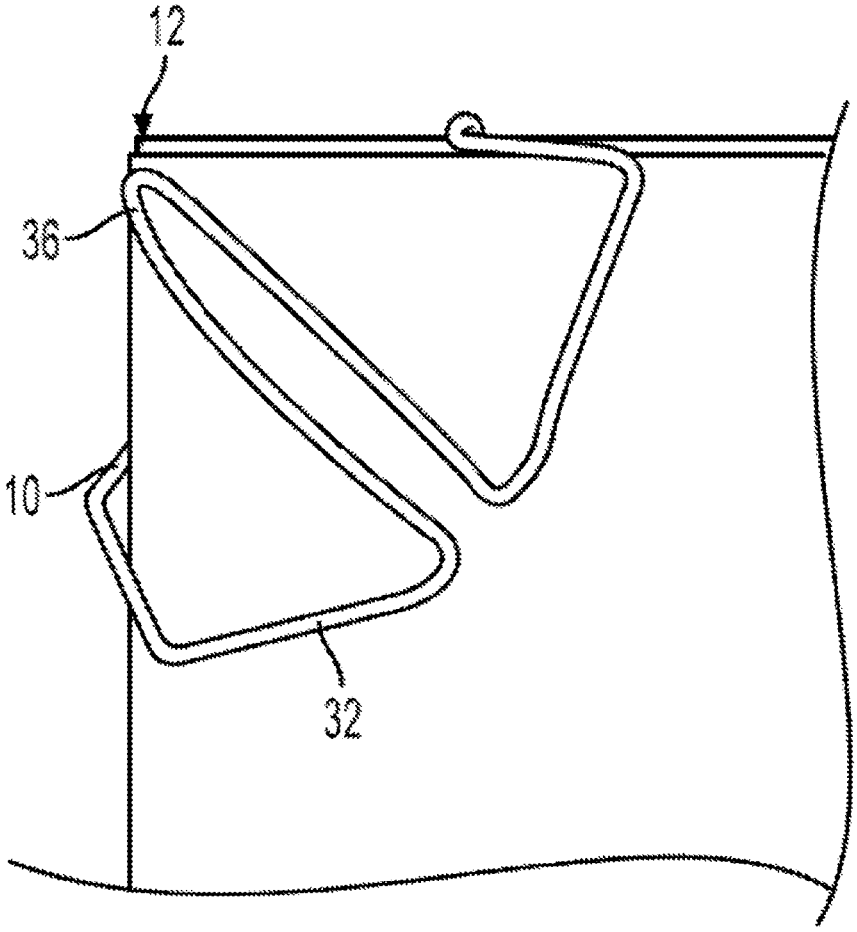
FIG. 6 shows the embodiment of FIG. 5 binding a stack of paper.
Figure 7:
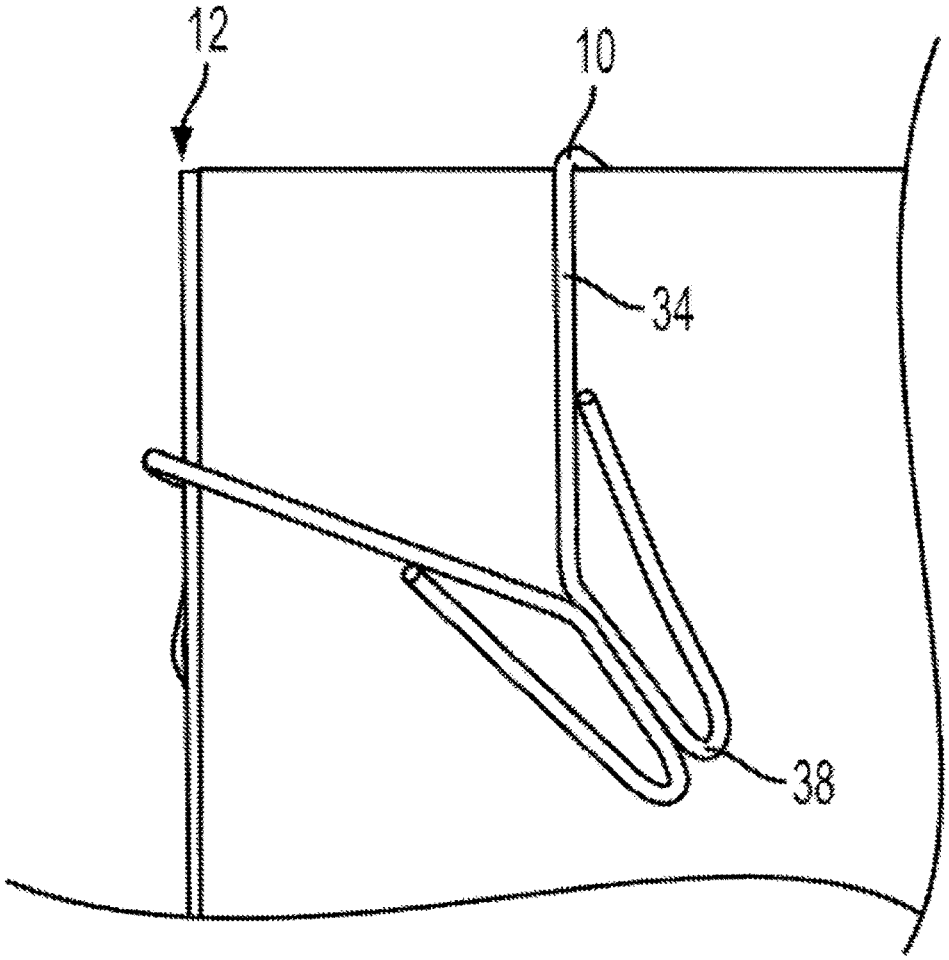
FIG. 7 shows the device of FIG. 6 viewed from the other surface of the stack.

On the opposite surface of the stack, surface segments 34 extend inward from the framing segments 10 to the second pressure member(s) 38. Depending on the material construction of a given embodiment one may have a single or two (or more) second surface pressure members. For example, when the clip is fabricated from bent wire the ends of the wire extending from the framing segment can advantageously end in a curved "U" shaped pressure point that parallels the surface of and applies pressure to the sheet along a considerable length of the member. The wire leading from the framing segment 10 advantageously forms an angle with the sheet surface to bias the second pressure members towards the first surface pressure member. In one embodiment the second surface pressure members apply force to the sheet on either side of the first surface pressure member and farther way from the corner of the sheet than the first surface pressure member (see FIG. 4). It is also possible to increase the length of the wire segments between the framing segments 10 and the second surface pressure members so the "U" shaped pressure points are coincident with the longitudinal axis of the first surface pressure member (see the wire embodiment of FIGS. 5, 6 and 7) but contact the sheet towards the base of the first surface pressure member (i.e., away from the corner of the paper). It is even possible to overlap the two "U" shaped second surface pressure members or link (e.g. twist or weld) the wire segments leading to the framing segments so that only a single "U" shaped second surface pressure member is formed.

Figure 8:
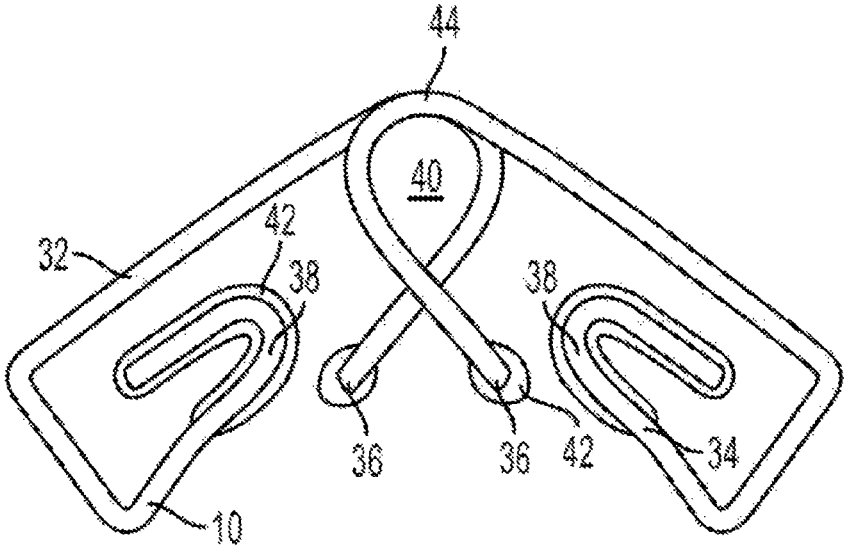
FIG. 8 shows a third bent wire embodiment.
Figure 9:
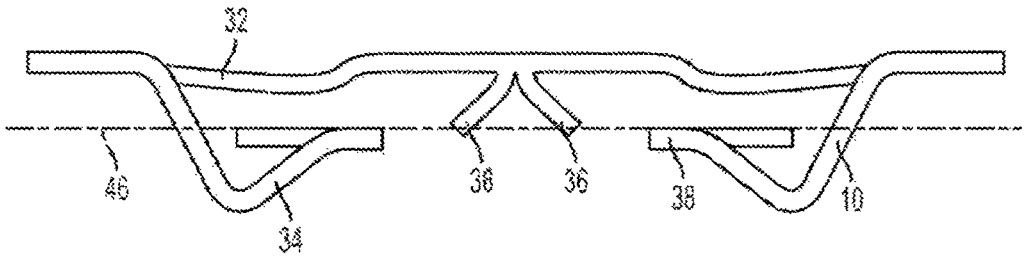
FIG. 9 shows a side view of the embodiment of FIG. 8.

FIGS. 8 and 9 show a view from above and side view, respectively, of a four pressure member wire embodiment. As seen from above a wire loop 40 is attached to the upper surface segments 32 and ends in two pressure members **36*a* and 36*b* that are bent down so that the wire tips apply pressure to the surface (see FIG. 9). The pressure members can advantageously have a plastic or rubber coating 42 to prevent the wire from digging into or marring the paper surface and to increase frictional grip. In addition, any portion of the wire can be machined to provide a grooved or other textured surface to enhance friction. The wire loop 40 can be formed from a separate length of bent wire welded to a separate length of wire forming the rest of the structure. Or the entire device can be formed from two pieces of wire, one forming the left side of the device (including one of the first surface pressure members) and the other forming the right side of the device (including the other first surface pressure member). A spot weld or a twist joins the two separate pieces where they overlap at 44**.

The side view in FIG. 9 shows that the upper and lower pressure members 36, 38 essentially lie on the same plane (dotted line 46). The lower pressure members 38 are joined to the framing segments 10 by short angled segments which flex resiliently to accommodate increasingly thick stacks of paper. That is, the sheets of paper are inserted approximately along the plane 46, between the upper and lower pressure members and force them apart. When the device is inserted over the corner of a stack, the upper surface pressure members 36 fall on either side of an imaginary line diagonally connecting the opposite corners of the paper. The lower pressure members 38 contact the paper sheet part of the way between the paper's edges and the diagonal line.

When the clip is molded from plastic as in the clip of FIG. 1, surface segments extend inward from the ends of the framing segments 10 at a right angle to the framing segments (parallel to the stack surface). These two surface segments join at a point more or less coincident with the base of the first surface pressure member. From this junction the second surface pressure member point 38 extends tongue-like along the axis defined by the first surface pressure member but away from the stack corner. Again, the second surface pressure member is resiliently angled or curved and biased towards the first surface pressure member so that a single sheet of paper can be gripped between the two pressure members. The framing segments 10 and the surface segments extending to the bases of the pressure members define a pocket which will accommodate a stack having the maximum allowable thickness (as determined by the length of the framing segments). The resilient biasing of the pressure members towards each other allows thinner stacks (down to a single sheet of paper) to be gripped.

The framing segments 10 accommodate and define the edges of the confined stack. The biased pressure members 36, 38 press the top sheet and the bottom sheet together to frictionally bind the stack. The precise position at which the pressure members apply their force can be adjusted by changing the configuration and length of the segments that attach the pressure members to the framing segments. While it is possible to have the first surface pressure member and the second surface pressure member apply pressure to regions that are vertically coincident in a stack, it has been found that such a configuration makes it somewhat more difficult to insert a stack of paper into the clip. This is because with the pressure members biased together, coincident pressure members will necessarily contact each other—much like one's thumb and first finger when making the "okay" sign. To insert a stack of sheets in such a case, it is necessarily to somehow grasp and separate the pressure members, which motion turns out to be somewhat clumsy and a bit difficult. However, when the contact regions for the pressure members are offset with the pressure member(s) on one surface contacting closer to the sheet corner than the pressure member(s) on the other surface, it is possible readily to thread the clip over the sheet corner with the sheets themselves applying the force to separate the pressure members. Also, in embodiments having a single first surface pressure member it is possible to use the first surface pressure member which contacts the sheet nearest the stack corner as a handle to hold and manipulate the clip.

It is useful to describe the insertion of a stack of papers into a generic clip (e.g. FIG. 1) of the present invention. The clip is conveniently gripped by means of the first surface pressure member 36 which acts somewhat as a handle. The clip is then slid over the corner of the stack along an imaginary line 50 from that corner to the opposite corner of the stack (e.g. along a diagonal of the sheet) until the second surface pressure member(s) slide beneath the lower surface of the stack. Then the entire clip is slid until further motion is limited by the framing segments contacting the sides of the stack. This motion is, perhaps, easiest with the polymeric embodiment (having a single second surface pressure member) or a wire embodiment where two pressure members together make contact at a location that lie more of less along the longitudinal axis of the first surface gripper because it is relatively simple to insert the corner into the clip so that the stack lies between the second and the first surface pressure members. It is possible to have multiple pressure members on each surface. Improved stability and ease of use is achieved by having the pressure members on one surface be farther away from the corner of the sheet than those on the opposite surface. A preferred embodiment is a single pressure member on each surface. In this instance "single" includes two pressure members that make contact in close proximity as in FIG. 7. Another preferred embodiment has a single pressure member (near the corner of the sheet) on one surface and two spaced apart pressure members on the other surface, those pressure members making contact farther away from the corner of the sheet and closer to the sheet edges than the axis defined by the first surface pressure point (e.g. FIG. 4). The clip can be modified to add a ridge or projection to the first surface pressure member 36 (or to both the first surface and the second surface pressure members) to make them more like a real handle. This can be combined with a composite structure where a separate spring material can be added to connect the base of the handle/pressure member to the rest of the clip body. Such a device is used by using the handle(s) to grasp and open the clip while sliding it over a stack.

Figure 10:
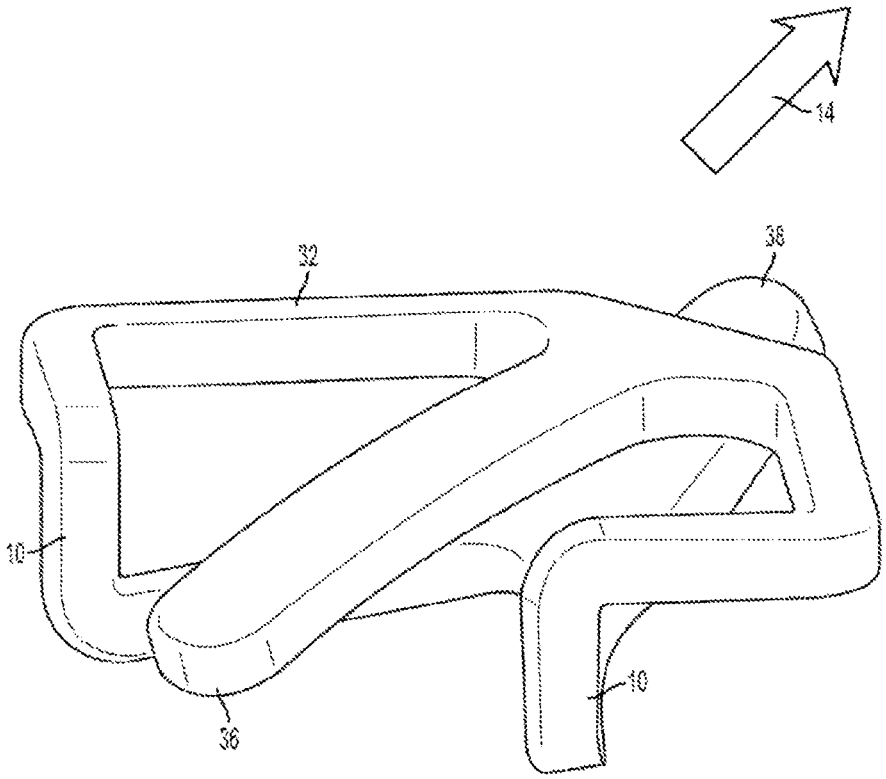
FIG. 10 shows a perspective view of an embodiment similar to that of FIG. 1 optimized for production.
Figure 11:
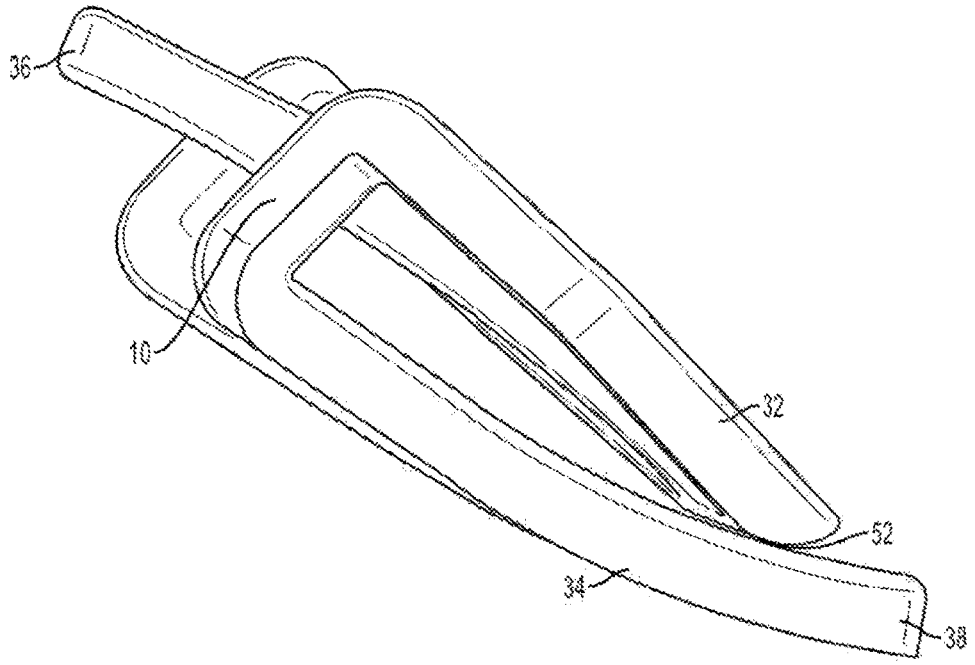
FIG. 11 shows a side view of the device of FIG. 10.

FIGS. 10 and 11 show an embodiment optimized for production from molded polymeric material. FIG. 10 is similar to FIG. 1 except that the junctures between the various segments of the device are rounded. To improve resiliency the right angle junctions between the framing segments and the surface segments can be rounded into even more sweeping radius bends than are shown in this drawing. FIG. 11 is a view from the side to illustrate the way the upper surface segments 32 are biased towards the lower surface segments 34 to create a very small gap 52 which is the same dimension as the thickness of only one or two sheets of paper.

Although the present clip is optimized for insertion over the corner of a stack of papers to bind them rather like a corner staple, the clip can also be inserted onto the side of a stack. In that case the framing segments will both intersect the same edge of the stack (as opposed to two edges on either side of a corner). This configuration does not supply the same dimensional stability as a two edge contact mode; however, the framing segments do limit sheet slippage and ensure edge alignment, and if two clips are inserted, spaced apart, along the long edge of a stack, a good facsimile of an edge (book style) binding can be achieved.

The following claims are thus to be understood to include what is specifically illustrated and described above, what is conceptually equivalent, what can be obviously substituted and also what incorporates the essential features of the invention. Those skilled in the art will appreciate that various adaptations and modifications of the just-described preferred embodiments can be configured without departing from the scope of the invention. The illustrated embodiment has been set forth only for the purposes of example and that should not be taken as limiting the invention. Within the scope of the appended claims, the invention may be practiced other than as specifically described above.

What is claimed is:

1. A clip for removably assembling and orienting a stack of sheets having planar surfaces when slid over a corner of the stack comprising:

a pair of spaced apart framing segments having first ends and second ends, the framing segments oriented substantially perpendicular to the planar surfaces before the clip is slid over the corner, both framing segments contacting and maintaining sides of the stack when the clip is slid over the corner of the stack, wherein orientation of the framing segments does not change when the clip is slid over the corner of the stack;

at least one first surface pressure member for applying pressure when the clip is slid over the corner of the stack, the pressure being applied to a first planar surface of the stack, wherein the at least one first surface pressure member is resiliently biased towards the first planar surface;

first surface segments connecting the at least one first surface pressure member and the first ends of the spaced apart framing segments;

at least one second surface pressure member for applying pressure when the clip is slid over the corner of the stack, the pressure being applied to a second planar surface of the stack, wherein the at least one second surface pressure member is resiliently biased towards the second planar surface;

second surface segments connecting the at least one second surface pressure member and the second ends of the spaced apart framing segments; and wherein the at least one first surface pressure member comprises a wire loop attached to the first surface segments with two ends of the wire loop bent toward the first planar surface.

2. The clip claimed in claim 1 formed from bent metal wire.

3. The clip claimed in claim 2, wherein the at least one second surface pressure member comprises two "U" shaped members formed from two of the second surface segments.

4. The clip claimed in claim 3, wherein the two "U" shaped members apply pressure to the second planar surface in proximity to or along a diagonal of the stack.

5. The clip claimed in claim 1, wherein pressure applied by the at least one first surface pressure, member is applied in proximity to or along a diagonal of the stack.

6. The clip claimed in claim 1, wherein pressure applied by the at least one second surface pressure member is applied at a region or regions farther from the corner of the stack than the pressure applied by the at least one first surface pressure member.

7. The clip claimed in claim 1, wherein a region of the clip is coated.

8. The clip claimed in claim 7, wherein the coated region forms at least a portion of one of the first surface or the second, surface pressure members.

* * * * *